US005180333A

United States Patent [19]

Shyu

[11] Patent Number: 5,180,333

[45] Date of Patent: Jan. 19, 1993

[54] VENTILATION DEVICE ADJUSTED AND CONTROLLED AUTOMATICALLY WITH MOVEMENT OF HUMAN BODY

[75] Inventor: Jia-Ming Shyu, Hsinchu, Taiwan

[73] Assignee: Norm Pacific Automation Corp., Hsinchu Hsien, Taiwan

[21] Appl. No.: 783,159

[22] Filed: Oct. 28, 1991

[51] Int. Cl.[5] ..... F24F 13/10

[52] U.S. Cl. ..... 454/319; 236/49.3; 454/320; 454/326

[58] Field of Search ..... 236/49.1, 49.3; 454/305, 309, 313, 318, 319, 320, 322, 326

[56] References Cited

U.S. PATENT DOCUMENTS

| | | | |
|---|---|---|---|
| 4,147,095 | 4/1979 | Jacobs | 454/313 |
| 4,729,293 | 3/1988 | Tsunoda | 454/313 |
| 5,039,008 | 8/1991 | Sugawara | 454/313 X |
| 5,097,672 | 3/1992 | Takenaka | 236/49.3 |

*Primary Examiner*—Robert G. Nilson
*Attorney, Agent, or Firm*—Spencer, Frank & Schneider

[57] ABSTRACT

A ventilation device, which comprises a sensor unit, a fan and control units to control on/off operation and the strength, temperature, humidity and directions of the wind or discharged air. The device can be applied to air conditioners, and ventilators. The sensor unit, monitoring the location and existence of human bodies within the ventilating area, enables the fan and the control units to be on or off while sensing the first person who comes into the area or the last person who leaves the area; and to adjust the strength and directions of the wind based on the location of the human bodies. The sensor unit, furthermore, can follow a specific human body and actuate the control units to provide needed wind based on his/her requirement. When the fan stops operating, all the openings of the ventilation device will shut so that the dust cannot get into the ventilation device.

20 Claims, 7 Drawing Sheets

VENTILATION DEVICE ADJUSTED AND CONTROLLED AUTOMATICALLY WITH MOVEMENT OF HUMAN BODY

BACKGROUND OF THE INVENTION

This invention relates to a ventilation device which can automatically turn on, turn off, adjust the blowing time, direction and conditions of air while detecting the occurrence and position of human bodies in the area to be ventilated.

The indoor ventilation devices of conventional air conditioners or the ventilation devices of general purpose electric fans usually use a set of control blades which can be manipulated manually or automatically to adjust the blowing direction i.e., the direction in which air is discharge. The blowing direction, however, can not be modulated to follow along the movement of human body. In other words, the blowing direction either is fixed or keeps moving to and fro within a certain range. This may cause unnecessary power consumption when nobody is in the area to be ventilated, or only those in the area can air flow. When the power of an air conditioner or a cooler/heater is turned on, the indoor temperature in the area to be ventilated can not be evenly warmed up or cooled down immediately, and people who stay in the area may feel sudden cool or sudden warm as they walk around. It takes time and consumes energy to achieve uniform temperature in the entire area. Furthermore people may have their preferred temperatures and blowing conditions—that is, the fixed temperature and blowing strength can not meet their respective preferences. Economically, to save energy, it is not necessary to cool/warm the whole room. In fact, as long as the ventilation device follows the movements of human bodies and blows wind relating to people's preferred wind strengths, temperatures and (relative) humidities, the ventilation requirements are met. Even when there are several persons in the room, the ventilation device can blow wind (discharge air) toward them respectively, instead of purposelessly blowing wind with the same speed through the whole area. Additionally, the power of the ventilation device automatically turns on as people enter the room and turns off as they leave the room. The strength or intensity of the blowing that follows the movement of the human body varies with the person's preference and the distance from the wind source to the person. Thus the wind speed that reaches the position of the person is just what is required. Accordingly to the present invention operations are the above mentioned all automatic and fulfils the energy saving policy.

Moreover, the ventilation outlets of the conventional air conditioners are usually left open. When the air conditioner is not in use, the outlets collect dust and insects; and as the air conditioner is turned on the next time, the impurities will be blown out into the ventilated area and the user feels uncomfortable. Furthermore, if the impurities get into the heat exchanger, they will cause a negative effect on the efficiency of the heat exchanger. Thereby, it is necessary to close all the ventilation outlets while not in use to keep the air conditioner clean and efficient.

SUMMARY OF THE INVENTION

To solve these mentioned problems, the present invention mainly provides a ventilation device which can automatically turn on, turn off, and modulate the blowing direction according to the position of the human bodies in the area to be ventilated.

The second object of this invention is provide a ventilation device which can modulate the blowing direction and strength or intensity of the discharged air based on the individual preference of the user and based upon the distance between the user and the device.

The third object of this invention is to provide a ventilation device which enables the blowing conditions, (fixed or varying strength, temperature, and humidity of the wind, direct or indirect blowing, etc.) and duration of blowing wind to be modulated based on the user's respective requirement.

The fourth object of this invention enables the ventilation device, while power is off, to close all the ventilation outlets to avoid dust entering the device.

To achieve the above mentioned objects, the ventilation device of this invention includes a wind source; a sensor unit and a group of control units to control the operation of the wind source, to vary the speed of the wind source, and to control the blowing conditions and the direction of wind. The sensor unit detects/measures the number and position of human bodies in the ventilating area, and then operates the control units to turn on the wind source and related control units when the first person gets in the room and to turn them off while the last person leaves the room. When the control units are on, the blowing direction and strength (intensity) will be modulated based on the location of the user. The sensor units will further trace or follow the specified objects which enable the control units to provide the required ventilation. When the ventilation device stops rotating, the outlets will be closed as well to avoid dust and impurities.

This invention will be best understood from the following descriptions of specific embodiments when read in connection with the accompanying drawings.

DESCRIPTION OF THE PREFERRED EMBODIMENT

Figure 1:
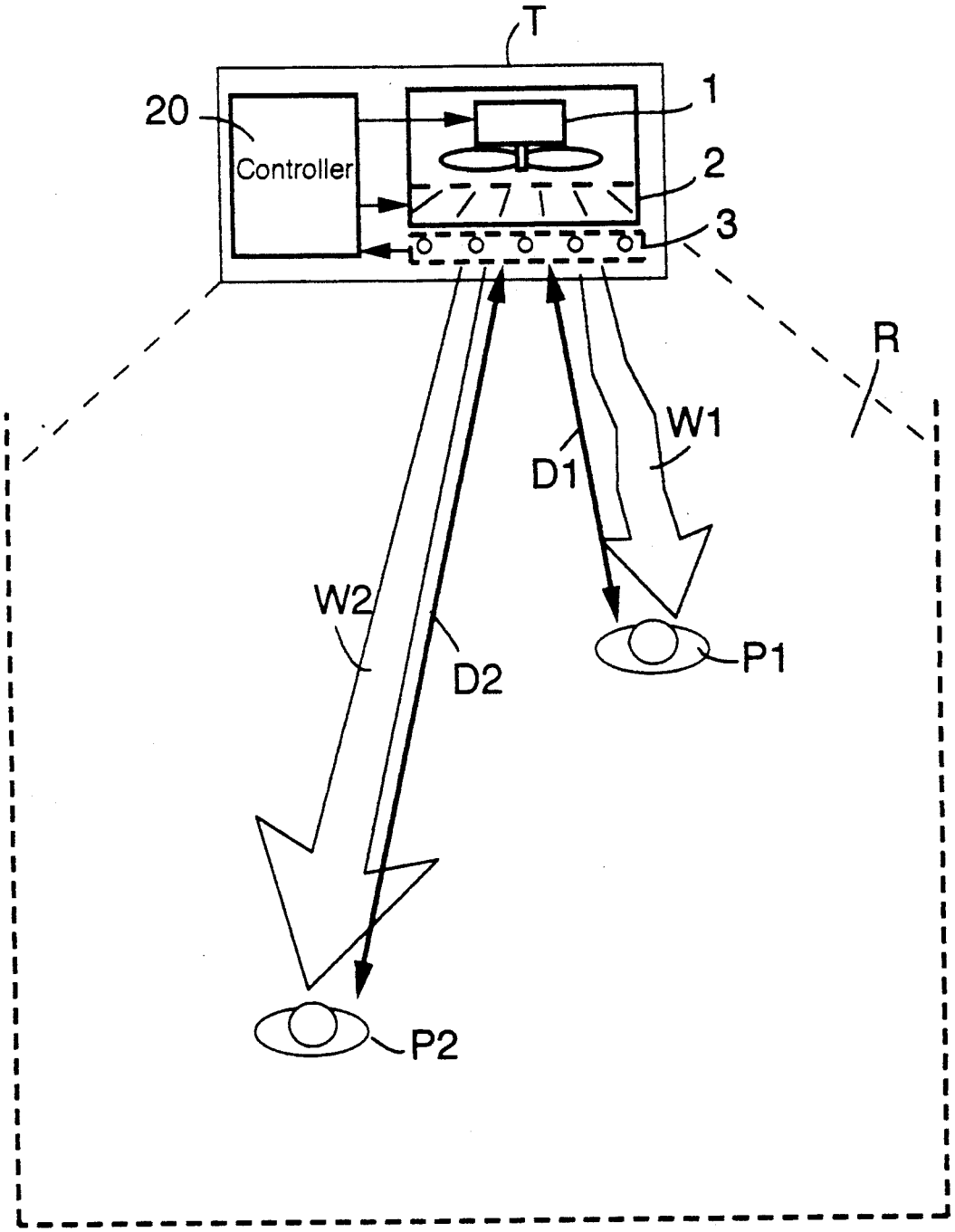
FIG. 1 is a diagram illustrating the basic structure of this invention.

As FIG. 1 shows, a ventilation device T of this invention mainly comprises of a wind source 1, a sensor unit 3, and a control device 2 to control the ON/OFF of the wind source and to vary the speed of the wind source 1 and to modulate the blowing condition and direction of wind. The sensor unit 3 is to detect/measure if there are any users P1, P2 in the ventilating area R and their locations. If the sensor unit 3 senses a person in the area, sensor unit 3 will send message to a controller 20 (such as a microcomputer), which can turn on the wind source 1 and the control device 2, and modulate the blowing direction and strength of the discharged air based on the location of the users. As shown in FIG. 1, wind source 1 blows gentle wind W1 to the user P1 who is close to the wind source 1, and strong wind W2 to the user P2 who is far from the wind source 1. When no person is sensed in the ventilating area, controller 20 enables the wind source 1 and the control device 2 to be turned off. The sensor unit 3, furthermore, can follow a specific user and enables the control device 2 to provide specific wind requested by the user. For example, when two users P1, P2 use the controller 20 to set respective requirements for cooler or warmer wind, the wind source 1 will generate the required wind (air) with fixed temperature and humidity, and the control device 2 will follow the users P1, P2 and provide stronger wind for a longer time, and gentle wind for a shorter time respectively. Alternatively, the wind source 1 will separately provides the users P1, P2 with air of different temperatures and humidities. The structure and function of the above mentioned device will be described in detail with the following embodiments.

Figure 2:
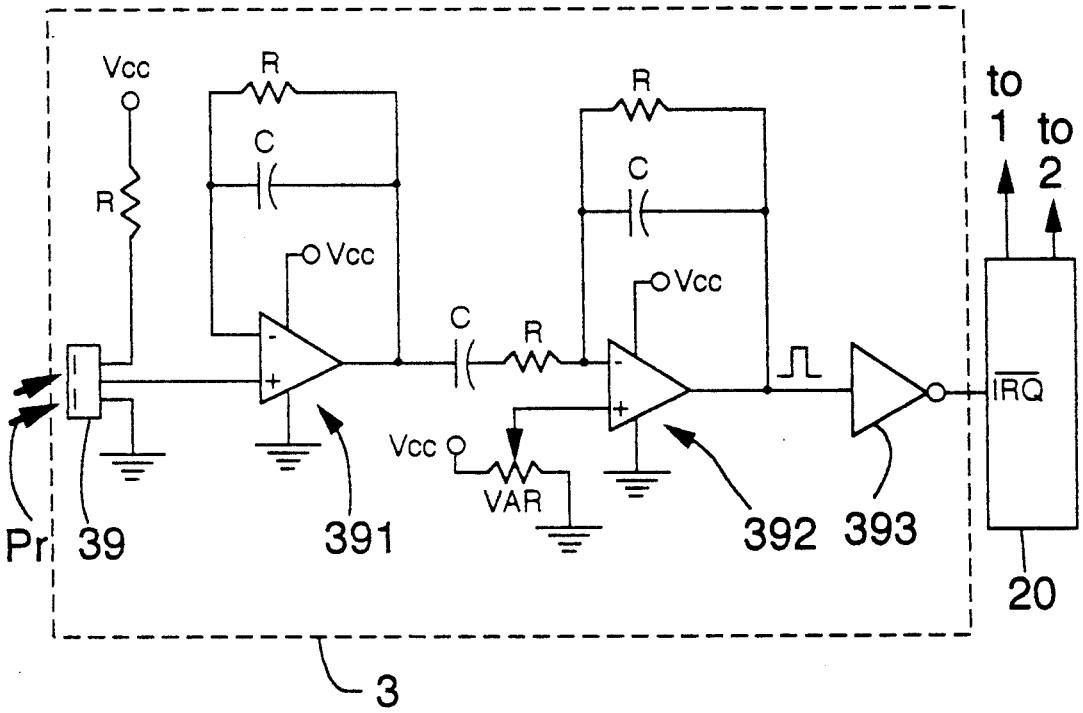
FIG. 2 is an embodiment of an electrical circuit structure illustrating a sensor unit and a controller of this invention.

FIG. 2 shows a basic structure of an electric circuit of an embodiment of this invention including the sensor unit 3 and the controller 20. The sensor unit 3 consists of one or several sensors 39 (only one sensor is shown in the figure) directed to respective sensing areas. The sensor 39 can be a prior art sensor, such as a pyroelectric-infrared sensor to sense the infrared radiation Pr of human body. The output signals from the sensor generate pulse signals through the amplification of an amplifier 391 and the check of a comparator 392, and then to an inverter 393 (it can be omitted which provides signals to) the controller 20. The controller 20 generates interrupt signals, and finally the wind source 1 and the control device 2 start to execute the required work based on the programming of unlisted software program.

Figure 3:
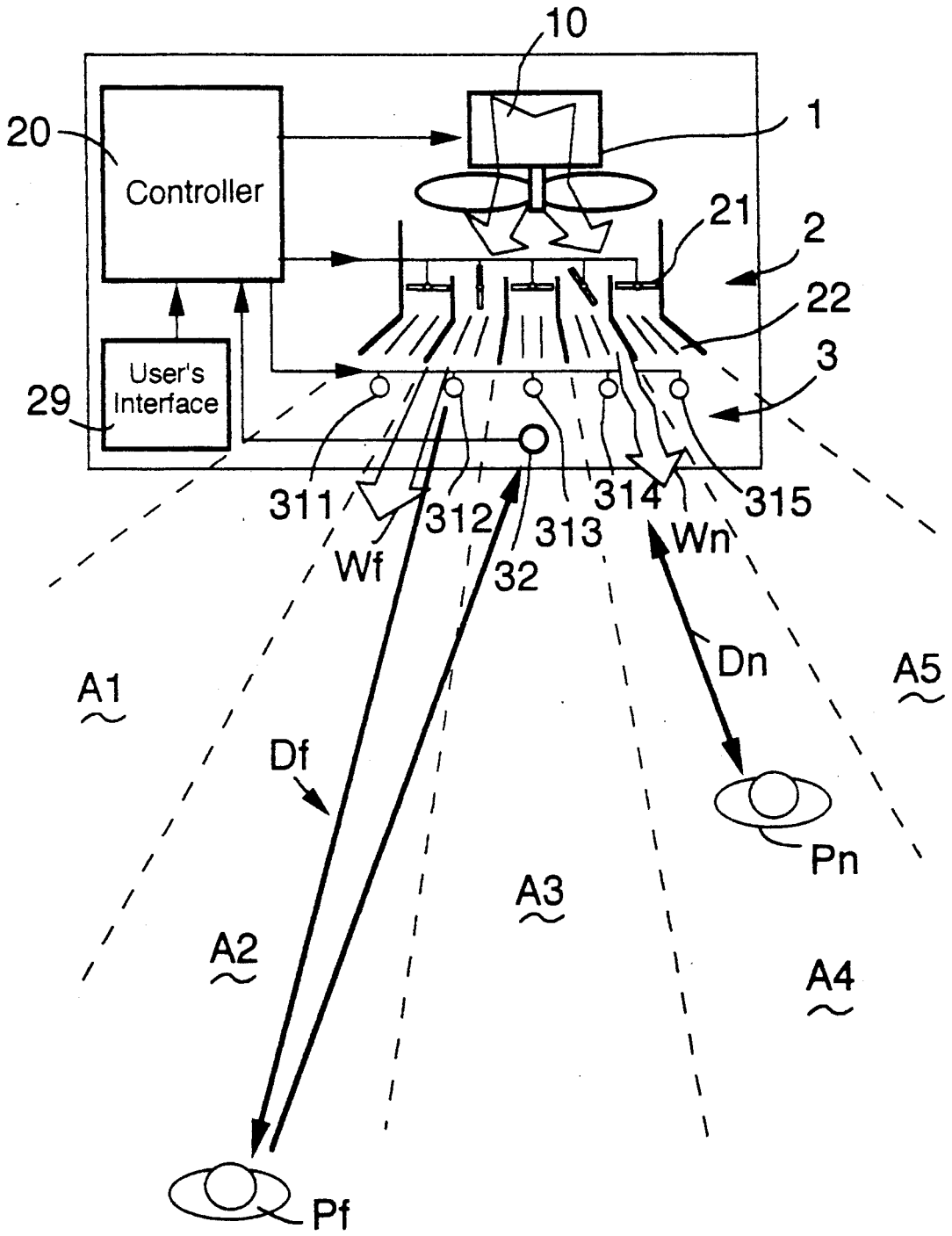
FIG. 3 is a diagram illustrating the structure and function of a first embodiment of this invention.

FIG. 3 shows the structure and function of a first embodiment of this invention. The wind source 1 mainly includes a fan which, based on the control of the controller 20, generates an adequate quantity of wind air. The control device 2 includes a number of wind flow-conduits 22 which direct discharged air to the ventilating areas A1, A2, A3, A4, A5, etc. respectively. Each flow-conduit 22 has a control valve 21 which, under the control of the controller 20, can modulate the ventilating volume of air discharged through each flow-conduit 22. Each valve can fully open to provide a large quantity of wind Wf, half open or open with any degree to provide a smaller quantity of wind Wn, or each valve can be totally closed. The sensor unit 3 has as many transmitters 311, 312, 313, 314, 315, etc. as the number of the flow-conduits 22, the transmitters may be of ultrasonic-wave, infrared rays, or a laser units. Each transducer corresponds to each flow-conduit 22 of the ventilating areas A1, A2, A3, A4, A5, etc., and consequently, each transmitter can send encoded signals to one ventilating area. For example, when there is a person Pf in the area A2, the signals sent from the transmitter 312 are reflected by the person Pf, received by a receiver 32 and judged by the controller 20 which can detect the user Pf and the distance Df in the area A2; and, a strong intensity wind Wf will be blown out consequently. A mild intensity wind Wn will be sent out to a user Pn in the shorter distance Dn of the area A4. The control device 2 controls each flow-conduit 22 corresponding with the movement of the people. Therefore, it follows people wherever they move, and makes ON/-OFF and ventilation economically; and whenever nobody is present in the ventilating areas, the control device 2 controls and turns off the wind source 1. The controller 20 also has a user's interface which enables the user to input the required ventilation conditions such as wind speed, temperature, humidity, natural-wind simulation, wind blowing to the users directly or indirectly, etc. The sensor unit 3 will follow the user and enables the control device 2 to provide adequate wind based on the specific requirements. For example, when an unshown user in the area A1 uses a user's interface 29 through a wiring or wireless control to input the specified ventilation requirement, the wind source 1 and the wind volume-control valve 21 corresponding to the area A1 will be adequately controlled by the controller 20, and consequently, the area A1 will get the needed ventilation. When the user moves from the area A1 to the area A2, the receiver 32 senses that the signal from reflection transmitter 311 disappears, and that the signal from transmitter 312 commences. As a result, the ventilation in the area A1 stops and that in the area A2 commences. If the user's requirement is not to ventilate directly but nearby, then to the user in the area A2, the control unit 2 controls the ventilation blowing in area A1 and A3 or an upper zone beyond the user instead.

A natural-wind simulation can be achieved by controlling the wind source 1 and the control valves 21 in a preset mode in which parameters are recorded and digitized from a natural wind environment. Therefore, the user can select the mode and enjoy a simulated natural wind.

Figure 4:
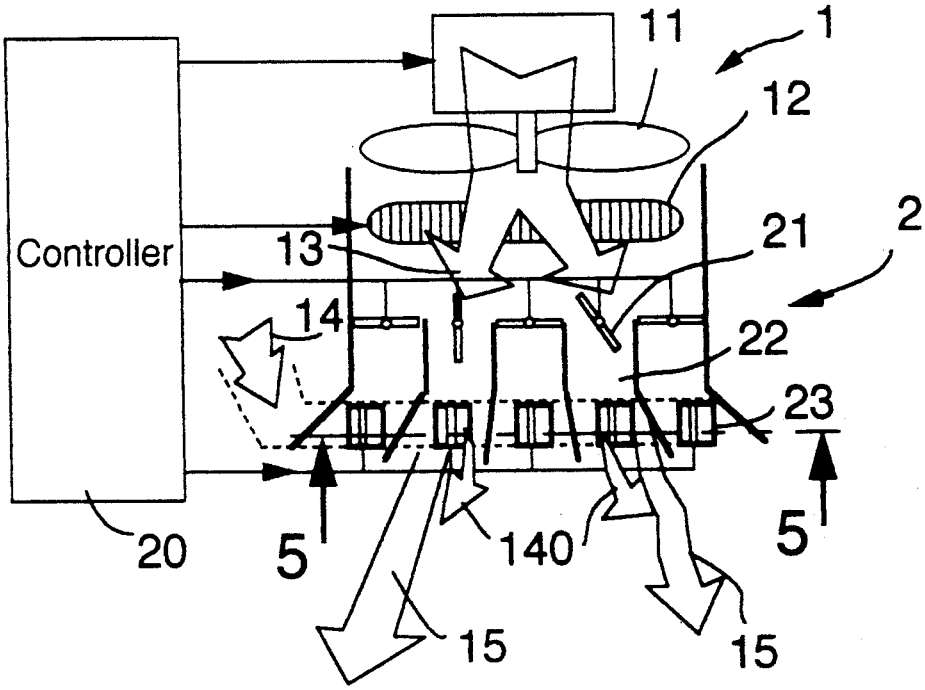
FIG. 4 is a diagram illustrating a variation of the first embodiment of this invention; wherein, the wind source and the control device can blow wind with respective temperatures.
Figure 5:
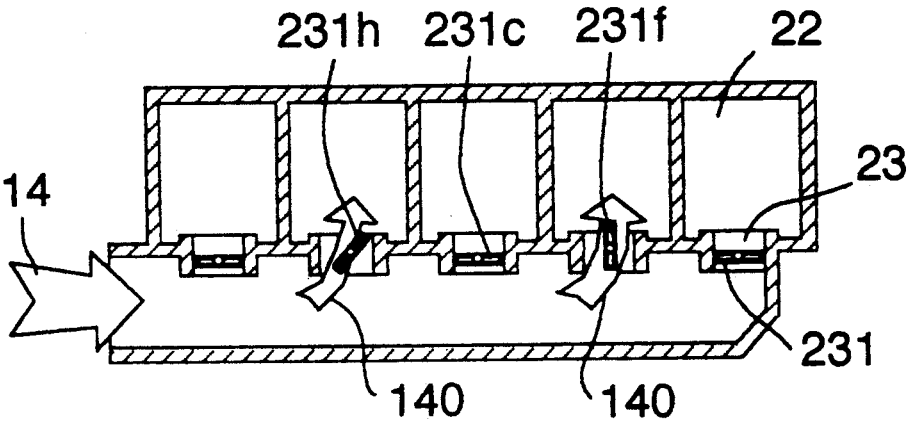
FIG. 5 is a sectional view in the position 5—5 of FIG. 4.

FIG. 4 illustrates an embodiment of the invention where the wind with different temperatures is blowing into different portions of the ventilation area, respectively, based on the control of the wind source 1 and the control device 2 of the above mentioned embodiment. FIG. 5 is a sectional view taken in the position 5—5 of FIG. 4. The wind source 1 in the embodiment of FIGS. 4 and 5 includes a fan 11 where the wind generated air flows through a heat exchanger 12. Then the air, with a certain temperature and humidity, leaves the heat exchanger and then is led through the control of each flow-conduit 22 via the control valve 21. Each flow-conduit 22, has an air-mixing entrance 23 connected to another wind source 14 which is of different temperature and humidity. Each entrance 23 has an air-mixing control valve 231 actuated by the controller 20 which can be, for example, fully-closed 231*c*, a fully-open 231*f*, a half-open 231*h* or partially open to permit adequate amount of air 140. The air 140 is mixed with air from flow-conduit 22, thus. the humidity is changed, the temperature is modulated and the mixed air comprises the discharged or output air 15. For example, we assume that through the operation of the heat exchanger 12, the generated wind 13 with temperature T1 and flow quantity Q1 mixes with the air 140 with temperature T2 and flow quantity Q2, and we will obtain a mixed air 15 at temperature (T1*Q1+T2*Q2)/(Q1+Q2) with flow quantity (Q1+Q2). Similarly, when the wind 13 with absolute humidity H1 and flow quantity Q1 mixes with the air 140 with absolute humidity H2 and flow quantity Q2, a mixed air 15 with absolute humidity (H1*Q1+H2*Q2)/(Q1+Q2) will be obtained. Consequently, the temperature and humidity of each mixed or discharged air 15 can be modulated by each flow quantity Q1, Q2 where the air 13, 140 pass through each flow-conduit 22 under the control of each valve 21, 231.

Figure 6:
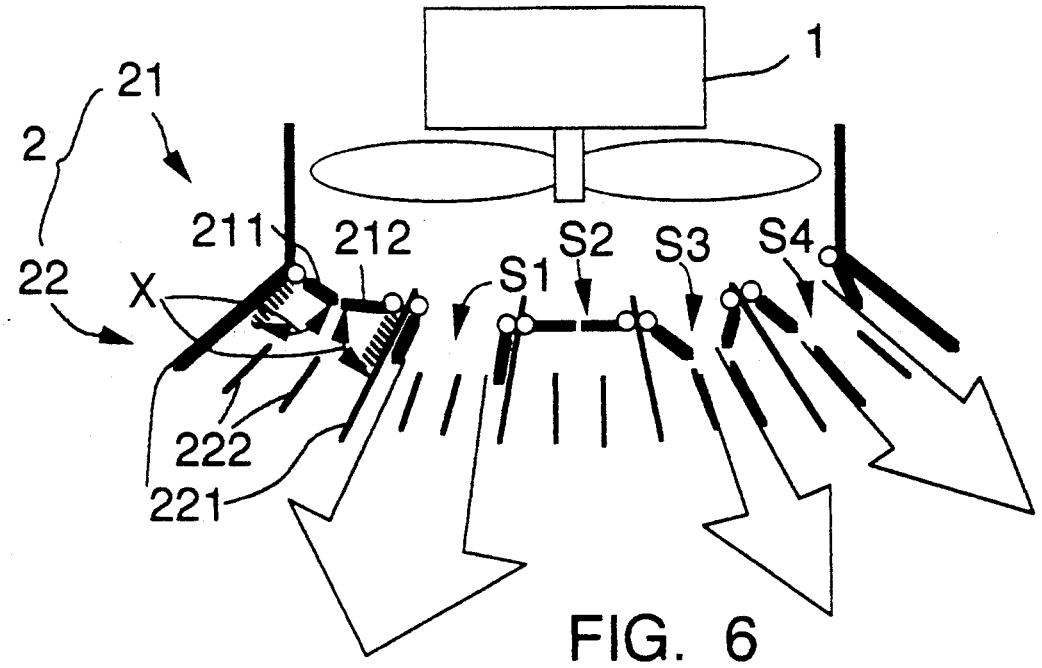
FIG. 6 is a diagram illustrating another variation of the first embodiment of this invention; wherein, the control device controls the blowing amount and direction of wind.

FIG. 6 shows another embodiment of this invention where the wind flow and blowing direction controlled by the control device 2 are exemplified. The flow output of the wind source 1 is controlled by the flow-conduit 22 and the control valve 21. Each control valve 21 consists of two flaps 211, 212 pivoted on the conduit wall 221 which flaps can be swung synchronously to open/close the conduit 22 as indicated by arrow X in the figure. The conduit 22 can be fully-open S1, fully-closed S2, half-open S3 or partially open S4 to allow needed air to flow into the conduit and be directed by the conduit wall 22 and a grille 222 which is fixed in the conduit to the specified direction.

Figure 7:
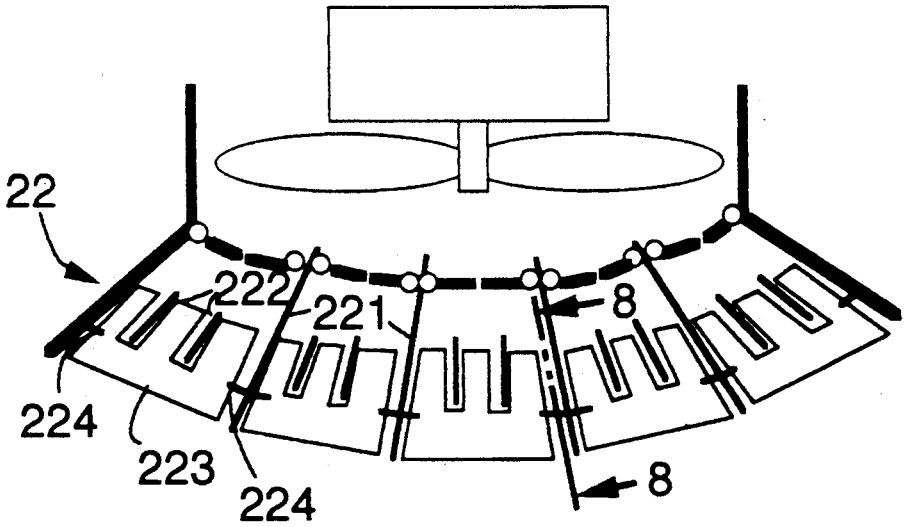
FIG. 7 is a diagram illustrating further variation of the first embodiment; wherein, the control device controls the blowing direction of wind.
Figure 8:
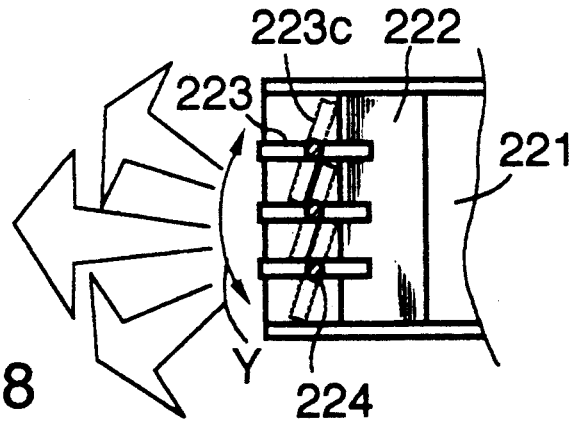
FIG. 8 is a sectional view in the position of 8—8 of FIG. 7.

FIG. 7 shows a further embodiment of the conduit 22 in FIG. 6. FIG. 8 is a sectional view in the position 8—8 of FIG. 7. This embodiment shows that in each conduit 22, besides the conduit wall 221 and the fixed grille 222 directing to a specified direction (usually it is a specified angle in the horizontal plane), there are several parallel movable-grilles 223 pivoted on the conduit wall 221 by the axles 224, which can direct air flow in another axial direction (for example, the vertical direction) as indicated by arrow Y. Another function of the movable grilles 223 is when they are positioned in the closed state 223*c*, as shown in FIG. 8, dust and impurities can be prevented from entering the device when the machine is off.

Figure 9:
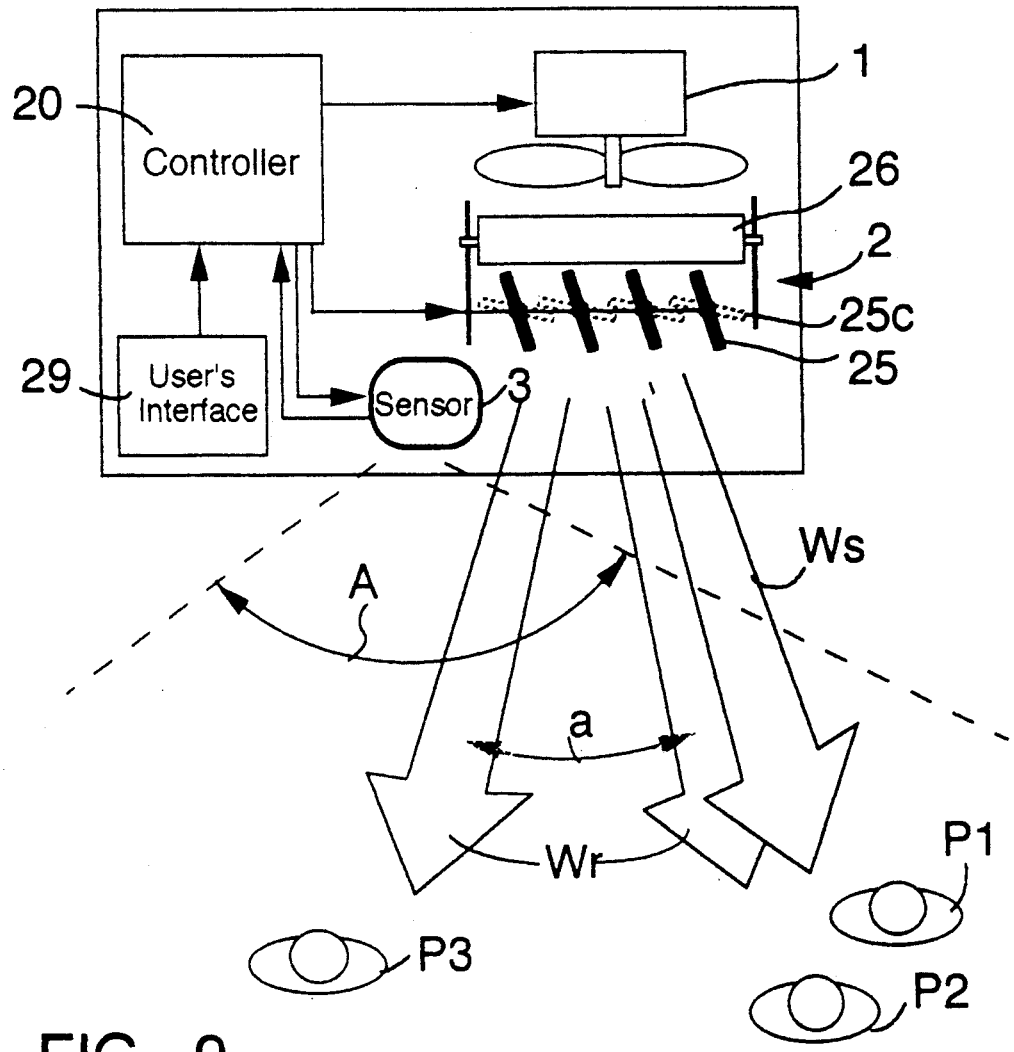
FIG. 9 is a diagram illustrating the structure and function of another embodiment of this invention.

FIG. 9 is the construction and function of another embodiment of this invention. In this embodiment, the same controller 20, the user's interface 29, the wind source 1, the control device 2, and the sensing unit 3 are included as in the first embodiment indicated in FIG. 2. In this embodiment the control device 2 consists of two sets of parallel movable-grilles 25 and 26 to regulate air flow in two perpendicular directions. (for example, horizontal and vertical directions.) The senses a unit 3 sensing human's existence or presence within an angle A and such presence will refuel the controller 20 to regulate the wind source 1 and the control device 2 for adequate air supply as indicated in the drawing. When the sensing unit 3 senses users P1, P2 at the same location in angle A, the control device 2 will blow wind Ws to one direction only. If there is more than one person and the persons are in different locations, (for example, there is a user P3 in another location) the control device 2 will then swing the grilles 25 and 26 to direct wind flow Wr into range "a" with varying direction. Further, the grille 25 can also be at a close-position 25*c* to avoid dust and impurities when the machine is not used.

Figure 10:
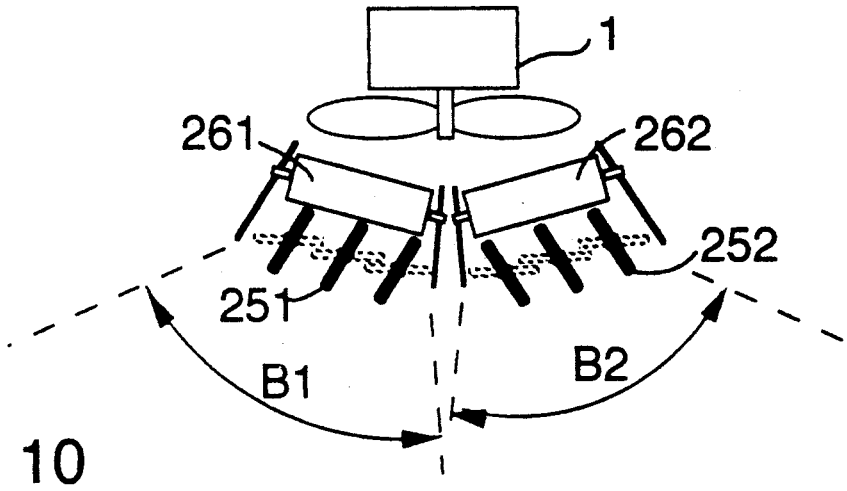
FIG. 10 is a diagram illustrating further variation of the control device of the embodiment of FIG. 9 of this invention.

FIG. 10 is a modified embodiment of the control device 2 of the FIG. 9. This embodiment contains two (or more) sets of movable grilles 251, 261 and 252, 262, which can swing independently to cover different wind-flow area B1 and B2. As a result, the whole service or ventilation area is expanded, each grille set will not swing with an extended range, and the overall efficiency is therefore improved.

The wind volume-control valves 21 (FIG. 3, FIG. 4), 211, 212 (FIG. 6), the mixed-air valve 231 (FIG. 5), and the movable grilles 223 (FIG. 7, 8), 25, 251, 252, 26, 261, 262 (FIG. 9, FIG. 10) in the above mentioned embodiment are actuated by unshown actuation devices (motors, solenoids, gears, screws, connecting rods, etc.) controlled by the controller 20. The controller 20, basically, is a microcomputer consisting of software program to execute the functions mentioned in the above embodiments; the sensor unit 3 and each actuation device also function based on it. These actuation devices and microcomputer can be easily obtained by the prior art and need not be described hereinafter.

Figure 11:
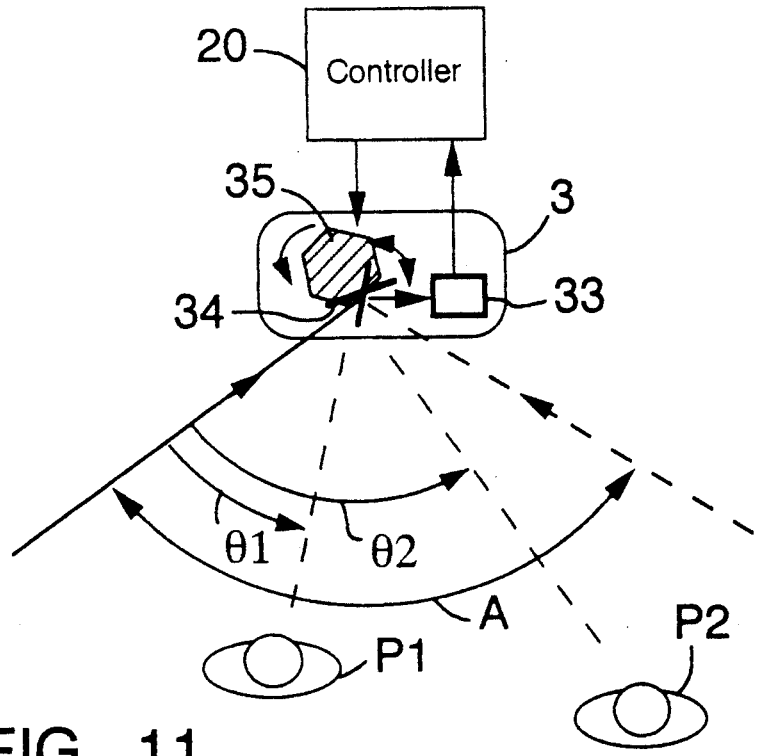
FIG. 11 is a diagram illustrating a sensor unit of an embodiment of this invention.
Figure 12:
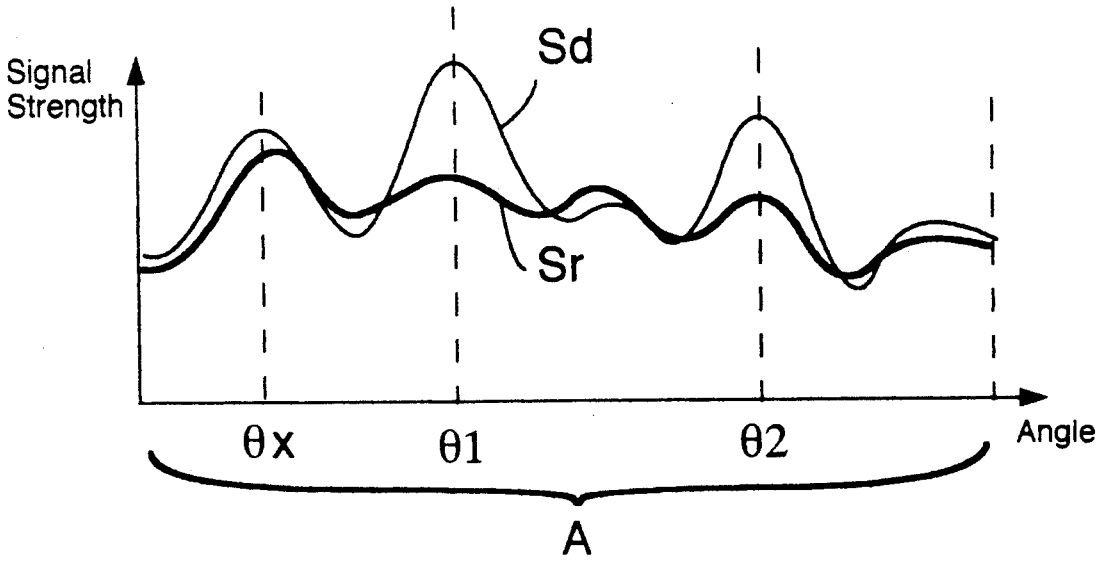
FIG. 12 is a diagram illustrating the function of the sensor unit of the embodiment of FIG. 10 which distinguishes the position of the human body.

FIGS. 11 and 12 show another embodiment of the sensing unit 3 and its function to distinguish the presence and position of a human body. The sensing unit 3 contains a sensor 33, such as an infrared sensor, combined with a rotating mirror 34 or multifaced mirror 35 to scan various zones in the range A. The zones can be in one or two dimensions. The sensor 33 can also be implemented as a rotating scanner. For example, in the figure, a user P1 is sensed at angle $\theta 1$, and another user P2 at angle $\theta 2$. The controller 20 will control the rotation of the mirror 34 or 35 and also process the signal sensed through the sensor 33. As FIG. 12 indicates, the controller 20 processes the detected signal Sd by comparing it with a reference signal Sr detected from a region with no human presence in range A. The reference signal may have included any fixed thermal source such as a machine, equipment, etc. The controller 20 will store the reference signals Sr into memory first and delete (neglect) the non-person thermal source signal during operation. Thus, the signals Sd at angle $\theta 1$ and $\theta 2$ will be compared with reference signals Sr to see if there is any obvious difference; if there is no obvious difference, the point $\theta x$ of non-person will be ascertained as no person present.

While the invention has been described by references to the specific embodiments chosen for purposes of illustration, it should be apparent that numerous modifications could be made thereto by those skilled in the art without departing from the spirit and scope of the invention.

What is claimed is:

1. A ventilation device, capable of adjusting and controlling itself automatically by detection of movement of a human body in a ventilating area comprising:

means for generating air to be discharged;

means for controlling the operation of said air generating means;

means for sensing the presence and location of said human body in said ventilating area and for generating signals in response to said presence and location; and input means for a user to input ventilation requirements of at least the direction of discharging air relative to the physical position of said user;

said controlling means responsive to the signals from said sensing means and the user input for discharging air to said user only when said user is detected in said ventilating area.

2. A device as defined in claim 1, wherein said controlling means automatically turns off said air generating means in the absence of a human body in said ventilating area.

3. A device as defined in claim 2 wherein said controlling means controls one or more of the temperature, humidity, speed, mode, and direction of said discharged air.

4. A device as defined in claim 1, wherein said ventilation device includes at least one outlet and said controlling means closes said outlet in the absence of person detected in said ventilating area to avoid dust or impurities from entering said device.

5. A device as defined in claim 1, wherein said controlling means includes at least one flow-conduit for directing the path of discharged air therethrough.

6. A device as defined in claim 5, wherein each flow-conduit includes a control valve controlled by said controlling means in a natural wind mode where control parameters are prerecorded from a natural wind environment.

7. A device as defined in claim 5, wherein each flow-conduit contains grilles to further modify said path of discharged air in two axes.

8. A device as defined in claim 5, wherein each flow-conduit contains a mixed-air entrance connecting to another source of air having a different temperature and humidity;

each said mixed-air entrance including a mixed-air valve operable for combining air of different temperatures and for regulating the output of temperature and humidity of mixed-air from each flow-conduit.

9. A device as defined in claim 1, wherein said controlling means includes at least a set of movable grilles which can be independently moved to provide a discharged air path which covers a least a part of said ventilating area based on said location of a human body sensed by said sensing means.

10. A device as defined in claim 1, wherein said sensing means includes at least two remote-measuring units to sense said location of said human body in different parts of said ventilating area.

11. A device as defined in claim 1, wherein said sensing means includes remote-measuring units which respectively scan said ventilating area with a scanning signal;

said sensing means receiving a reference signal in the absence of a human body in said ventilating area and receiving signals reflected from a human body, for comparing with said reference signal said location of a human body being based on the difference of said comparison of said reference signal and said reflected signal.

12. A device as defined in claim 1, wherein said controlling means includes at least one flow-conduit for adjusting the volume of discharged air flowing therethrough.

13. A device as defined in claim 12 wherein said controlling means includes a control valve for adjusting the volume and direction of discharged air flowing therethrough.

14. A ventilation device adjusted and controlled in response to the presence and movement of human bodies within an area to be ventilated comprising:

sensing means for monitoring an area to be ventilated and for providing an output signal upon detecting the presence of at least one human body in the area to be ventilated;

means for discharging air through at least one aperture into the area to be ventilated; and control means responsive to the signal from said sensing means for controlling the operation of said air discharging means;

said control means for closing said aperture in the absence of at least one human body detected in the area to be ventilated.

15. A device as defined in claim 14 wherein said control means controls one or more of the (a) temperature, (b) humidity, (c) flow intensity, and (d) flow direction of the discharged air.

16. A device as defined in claim 14 wherein said control means includes at least two flow-conduits, each directed to discharge air to a different portion of said ventilation area.

17. A device as defined in claim 16 wherein said flow-conduits including a valve for regulating the volume of air flowing therethrough.

18. A device as defined in claim 14 wherein said control means includes at least one rotatable grille for regulating the direction of air flowing therethrough.

19. A device as defined in claim 18 wherein said control means includes at least a pair of grilles rotatable for regulating the direction of air flowing therethrough in two axes.

20. A device as defined in claim 14 wherein said sensing means includes at least one remote-measuring unit for scanning said ventilating area with a scanning signal;

said sensing means receiving a reference signal from said ventilating area in the absence of detecting a human body in said ventilating area;

said sensing means receiving a reflected signal from said ventilating area upon detecting a human body in said ventilating area; and said sensing means for comparing the difference between said reflected signal and said reference signal to determine the location of a human body in said ventilating area.

* * * * *